United States Patent [19]

Prinz

[11] Patent Number: 4,578,838

[45] Date of Patent: Apr. 1, 1986

[54] SLUICE FOR CLEANING BODIES

[75] Inventor: Benjamin Prinz, Gelsenkirchen, Fed. Rep. of Germany

[73] Assignee: Taprogge Gesellschaft mbH, Wetter, Ruhr, Fed. Rep. of Germany

[21] Appl. No.: 705,088

[22] Filed: Feb. 25, 1985

[30] Foreign Application Priority Data

Feb. 25, 1984 [DE] Fed. Rep. of Germany ..... 3406982

[51] Int. Cl.[4] ..... F28G 1/12

[52] U.S. Cl. ..... 15/104.06 A; 15/3.51; 165/95

[58] Field of Search ..... 15/3.5, 3.51, 104.06 A; 165/95

[56] References Cited

U.S. PATENT DOCUMENTS

| | | | |
|---|---|---|---|
| 3,021,117 | 2/1962 | Taprogge | 165/95 |
| 4,350,202 | 9/1982 | Schulz | 165/95 |
| 4,523,634 | 6/1985 | Bizard | 165/95 |

*Primary Examiner*—Edward L. Roberts

*Attorney, Agent, or Firm*—Herbert L. Lerner; Laurence A. Greenberg

[57] ABSTRACT

A sluice for cleaning bodies includes a sluice housing having two substantially hemispherical housing halves, flanges each being disposed on a respective housing half for interconnecting the halves, substantially radially projecting stubs disposed on each respective housing half including at least one inlet and at least one outlet stub for flow medium carrying the cleaning bodies, and a screen element disposed in the housing for covering at least one of the inlet and outlet stubs.

12 Claims, 7 Drawing Figures

SLUICE FOR CLEANING BODIES

The invention relates to a sluice or sluice chamber for cleaning bodies, especially sponge rubber spheres, in cleaning installations of tube heat exchangers, including a sluice housing having at least one inlet stub and an outlet stub for the flow of medium which carries the cleaning bodies.

For instance, a sluice of this kind is known from German Pat. DE-PS No. 32 27 709, which is formed of a vertically positioned cylindrical housing with a built-in conical sieve or screen to which a flow medium loaded with cleaning bodies is admitted from the top through a connecting pipe attached at the side thereof. A trap door is provided at the discharge pipe at the small end of the sieve or screen, through which the flow medium with the cleaning bodies can be either conducted to the inlet pipe of the heat exchanger which is to be cleaned, or the cleaning bodies can be held back. In order to exchange the retained cleaning bodies in such a device, it is necessary to remove the cover plate of the sluice and to remove and exchange the cleaning bodies more or less manually.

Furthermore, German Published, Non-Prosecuted Application DE-OS No. 31 12 968 discloses a sluice with a cylindrical, horizontally disposed sluice housing, with a semi-cylindrical sieve or screen member for catching the cleaning bodies after the installation has been taken out of operation. The sieve or screen member can be moved out from one of the end walls of the slucie which are opendable, in order to exchange the cleaning bodies outside of the slucie.

In both conventional sluices, for strength reasons the cylindrical configuration of the housing requires great thickness of the container walls as well as a considerable thickness of the cover, which becomes very costly if high quality materials are used. Furthermore, depending on the arrangement and location of these sluices and the space conditions determined thereby, the pipe connections must be specially arranged and positioned for each case, so that different configurations of the container are always necessary.

It is accordingly an object of the invention, to provide a sluice for cleaning bodies, which overcomes the hereinafore-mentioned disadvantages of the heretofore-known devices of this general type, in which the removal and refilling of the cleaning bodies can be performed without manually opening and physically entering the sluice and in which a simple adaptation of the flange connections for inflow, outflow and manipulation inlets for the different conditions dependent on location, is made possible during the installation of the sluice.

With foregoing and other objects in view there is provided, in accordance with the invention, a sluice for cleaning bodies, especially sponge rubber spheres, comprising a sluice housing of a cleaning installation for tube heat exchangers having two substantially hemispherical housing halves, flanges each being disposed on a respective housing half for interconnecting the halves, substantially radially projecting stubs disposed on each respective housing half including at least one inlet and at least one outlet stub for inlet and outlet lines for flow medium carrying the cleaning bodies, and a screen or sieve element disposed in the housing for covering at least one of the inlet and/or outlet stubs.

With such a configuration of the sluice with a spherical housing, lesser wall thicknesses can be used and due to the symmetrical construction, connections can be chosen and exchanges suiting the respective location of the corresponding connection fittings. Through a suitable arrangement of the screen element, it also becomes possible to let the cleaning bodies drop directly out of the spherical housing.

In accordance with another feature of the invention, the stubs include three stubs mutually spaced apart by substantially 120° on each respective housing half.

In accordance with a further feature of the invention, the stubs are inclined at an angle of between substantially 30° and 60° relative to the horizontal.

In accordance with an added feature of the invention, the flanges are substantially horizontal.

In accordance with an additional feature of the invention, the housing halves are in the form of an upper half having an uppermost point and a lower half having a lowermost half, and including a ventilating stub disposed at the uppermost point and a drain stub disposed at the lowermost point.

In accordance with again another feature of the invention, the housing halves are upper and lower halves, the screen element is circular, is disposed at a given location above the stubs disposed on the lower housing half, and covers the cross-sectional area of the lower housing half at the given location.

In accordance with again a further feature of the invention, the housing includes a parting line along which the flanges are disposed, and the screen element is parallel to and below the parting line, and including a drive for driving and tilting the screen element, the drive having a flange connected to one of the stubs disposed on the lower housing half and the drive being connected to the screen element, the drive having a slanted drive axis passing outside the center of the screen element and being coextensive with an imaginary line intersecting the center of the housing.

Such a construction of the screen element and a suitable drive guarantee that as the screen element is moved, it describes a path in which each point of periphery of the screen is in constant contact with the spherical surface of the sluice housing. It is therefore always possible to cover one or more of the stub outlets with the screen element and accordingly prevent the egress of the spherical bodies or balls.

In accordance with again an added feature of the invention, the housing halves are identical. This enhances the flexibility or adaptability of the sluice.

In accordance with again an additional feature of the invention, the stubs disposed on the upper housing half are in the form of a flow inlet, a refilling opening for the cleaning bodies and an inspection window or glass, and the stubs disposed on the lower housing half are in the form of a flow outlet, a removal outlet for the cleaning bodies, and the one stub to which the drive flange is connected.

In accordance with yet another feature of the invention, the housing halves are selectively positioned relative to each other. This makes it possible to better adapt to local conditions.

In accordance with a concomitant feature of the invention, there is provided an intermediate tubular member having two flanges, disposed between the housing halves. This leads to an increase in the operating volume of the sluice, while maintaining the same functional features.

Other features which are considered as characteristic for the invention are set forth in the appended claims.

Although the invention is set forth and described herein as embodied in a sluice for cleaning bodies, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
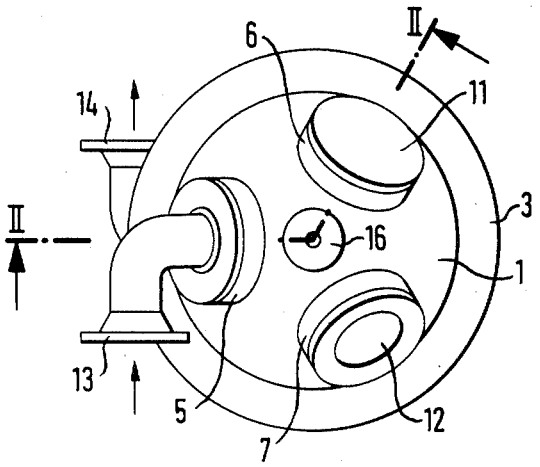
FIG. 1 is a top plan view of the sluice of the invention.
Figure 2:
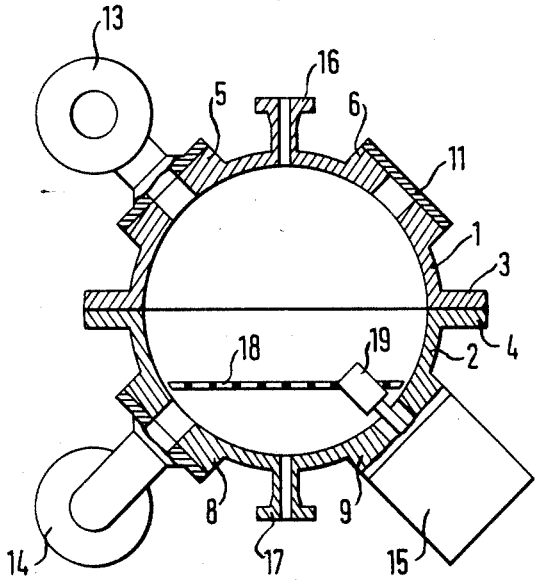
FIG. 2 is a longitudinal-sectional view through the sluice taken along the line II—II in FIG. 1, in the direction of the arrows, with the drive of the sluice rotated into the section plane.

Referring now to the figures of the drawings in detail, and first particularly to FIGS. 1 and 2 thereof, it is seen that the sluice or sluice chamber is formed of two semi-spherical housing halves 1 and 2, which are bolted to each other at their horizontal parting plane by respective flanges 3 and 4. In the illustrated embodiment, the upper housing half 1 is provided with three radially protruding short pipes or stubs 5, 6 and 7 which are disposed at 120° relative to each other and which are inclined about 45° relative to the horizontal.

In a similar way, the lower half 2 of the spherical housing is provided with three short pipes or stubs 8, 9 and 10, although the stub 10 is not illustrated in FIGS. 1 and 2. The stubs 8–10 are placed at suitable angles with respect to each other like the upper stubs 5, 6 and 7. It can be seen from this embodiment that the stub 5 which has a flow or current inlet 13 can be used as an inlet stub, the stub 6 which is closed by a cover 11 can be used for refilling the cleaning bodies, and the stub 7, which is provided with an inspection window 12, can be used for inspecting the interior of the sluice. At the lower half 2 of the spherical housing, the stub 8 can be used for attaching a discharge outlet 14 for liquid, the stub 9 can be used for the positioning drive 15 for a sieve or screen 18 which will be explained below, and the stub 10 can be used for removing the cleaning bodies.

Additionally, the upper housing half 1 is provided with a ventilating pipe or stub 16 at its highest point, and the lower housing half 2 has a drain pipe or stub 17 at its lowest point for draining the water in the sluice.

The illustrated configuration of the two spherical housing halves 1 and 2 with the radially protruding stubs 5 to 10, makes it possible to construct the sluice with very small wall thicknesses. This is especially important if the sluice is made of costly material. The radial disposition of the stubs permits machining of the openings in a boring mill, because the cross sections of the stubs at the surface of the sphere are circular openings. Furthermore, this configuration causes the manufacturing costs to be reduced and an unusual flexibility is obtained, because the functions of the various pipes can be interchanged. Additionally, the two hemispherical shells can be selectively positioned with respect to each other, in order to permit different dispositions according to the given space conditions, even before installation.

As shown in FIG. 2, a circular sieve or screen element 18 is provided for the exchange of the cleaning bodies and their separation from the flow medium. The circular sieve or screen element 18 which covers the entire cross section of the housing in its position in the housing, can tilt. The screen element 18 is disposed above the openings of the stubs 8, 9 and 10 of the lower shell half 2 and below and parallel to the plane of the flanges 3, 4. A drive 15 is attached at the flanges of the lower stub 9 for tilting the screen element 18. A drive shaft 19 extends through the screen or mesh element 18 at a slant outside the center of the circular area thereof, and in practice it lies along an imaginary axis, which intersects the centerpoint of the spherical housing. As the drive shaft 19 rotates, the screen element 18 tilts inside the sluice housing, and due to its geometry, the screen element 18 describes a path in which the periphery of the screen element 18 always lies at the inner surface of the spherical housing.

Figure 3B:
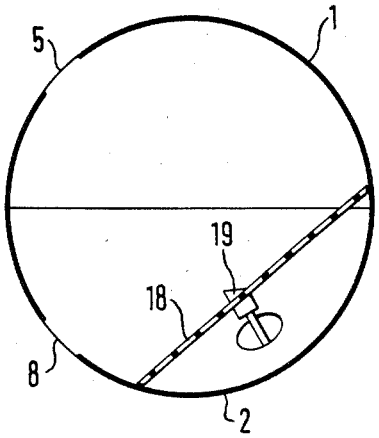
FIG. 3B is a corresponding longitudinal-sectional view through the sluice with the screen element in the operating position.
Figure 3A:
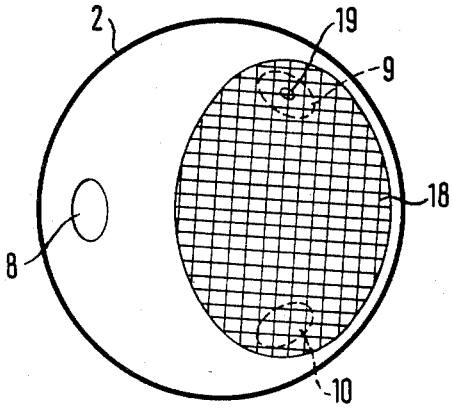
FIG. 3A is a cross-sectional view through the sluice with the screen element in the operating position.
Figure 4:
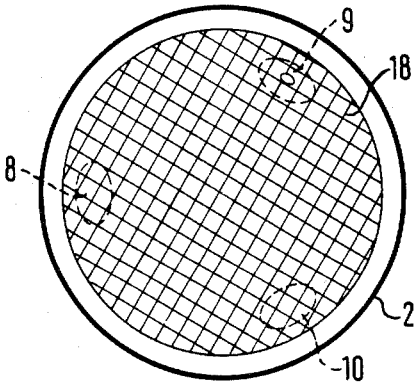
FIG. 4 is a cross-sectional view through the sluice with the screen element in the catching position.
Figure 5:
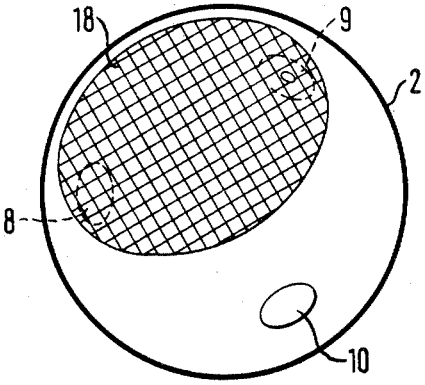
FIG. 5 is a cross-sectional view through the sluice with the screen element in position for removing the cleaning bodies.

In FIGS. 3 to 5, different operating positions of the screen element 18 are shown and described below in order to explain the various setting possibilities.

FIG. 3A is a diagrammatic view of the interior of the sluice chamber looking onto the lower spherical housing part 2 with the outlet stub 8, the stub 9 for the drive motor 15, with the drive shaft 19, as well as the stub 10 for the removal of the cleaning bodies. If the screen element is tilted according to the illustrated position and positioned transversely, according to the position shown in cross section in FIG. 3B, the outlet stub 8 is exposed by the screen element and is open, while the stub 10 for the removal of the cleaning bodies is covered. In this so-called operating position, a free passage from the inlet stub 5 to the outlet stub 8 is established, so that none of the cleaning bodies can be held back.

In the top plan view according to FIG. 4, the screen or mesh element 18 is in the so-called catching position and therefore corresponds to the position shown in FIG. 2. The lower stubs 8, 9 and 10 are therefore shielded with respect to the passage of the cleaning bodies, so that the flow medium without cleaning bodies can be discharged through the stub 8.

After all of the cleaning bodies are collected on the screen element 18 and the water is drained either through the discharge stub 8 or through opening of the ventilating stub 16 and the water drain stub 17, the screen element is tilted into the position shown in FIG. 5, wherein only the outlet stub 8 is screened.

After opening the removal stub 10, all of the cleaning bodies fall out from the stub by positioning the screen element 18 in a suitably slanted position. The fall of the cleaning bodies may be additionally aided by suitably moving the screen element 18. New cleaning bodies can be subsequently filled into the refilling stub 6 after the cover 11 is removed and after the screen element 18 is moved to the position shown in FIG. 3A. The cleaning operation can then be restarted.

In this way it is possible to remove cleaning bodies from the sluice and to fill new cleaning bodies into the sluice in a simple manner, without requiring any manual access to the sluice.

Figure 6:
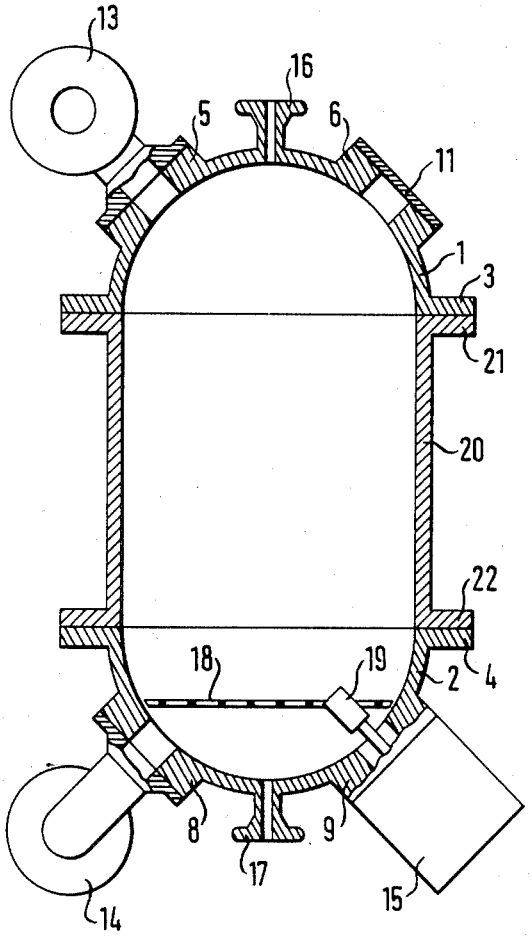
FIG. 6 is a longitudinal-sectional view through the housing of the sluice, with the addition of a tublar intermediate section.

In an additional embodiment illustrated in FIG. 6, it is seen how the volume of the sluice can be increased in a simple way, without any changes in the essential parts. As the drawing shows, a tubular intermediate piece 20 with two connection flanges 21 and 22 is inserted between the two spherical housing halves 1 and 2. The length of the intermediate piece 20 can be altered as required, so that the volume of the sluice can be increased within relatively wide limits without making a change in the configuration of the two spherical housing halves or their functional elements.

The result of the above-described measures is a sluice chamber with a simple construction, which guarantees high adaptability with respect to construction and technological application, so that an especially great adaptability to the particular location is possible even during mounting, since the connection can be chosen to suit the conditions of the particular location. With the abovedescribed construction and mobility of the screen element, all of the functions of the sluice can be carried out in a simple manner, so that it is possible to select screen dispositions within the frame of the invention which enable the retention and automated removal of the cleaning bodies.

The foregoing is a description corresponding in substance to German application P No. 34 06 982.8, filed Feb. 25, 1984, the International priority of which is being claimed for the instant application, and which is hereby made part of this application. Any material discrepancies between the foregoing specification and the aforementioned corresponding German application are to be resolved in favor of the latter.

I claim:

1. Sluice for cleaning bodies, comprising a sluice housing having two substantially hemispherical housing halves, flanges each being disposed on a respective housing half for interconnecting said halves, substantially radially projecting stubs disposed on each respective housing half including at least one inlet and at least one outlet stub for flow medium carrying the cleaning bodies, a screen element disposed in said housing for selectively covering at least one of said inlet and outlet stubs, and means for selectively positioning said screen in said housing.

2. Sluice according to claim 1, wherein said stubs include three stubs mutually spaced apart by substantially 120° on each respective housing half.

3. Sluice according to claim 2, wherein said stubs are inclined at an angle of between substantially 30° and 60° relative to the horizontal.

4. Sluice according to claim 1, wherein said flanges are substantially horizontal.

5. Sluice according to claim 1, wherein said housing halves are in the form of an upper half having an uppermost point and a lower half having a lowermost half, and including a ventilating stub disposed at said uppermost point and a drain stub disposed at said lowermost point.

6. Sluice according to claim 1, wherein said housing halves are upper and lower halves, said screen element is circular, is disposed at a given location above said stubs disposed on said lower housing half, and covers the cross-sectional area of said lower housing half at said given location.

7. Sluice according to claim 6, wherein said housing includes a parting line along which said flanges are disposed, and said screen element is parallel to and below said parting line, and said means including a drive for driving and tilting said screen element, said drive having a flange connected to one of said stubs disposed on said lower housing half and said drive being connected to said screen element, said drive having a slanted drive axis passing outside the center of said screen element and being coextensive with an imaginary line intersecting the center of said housing

8. Sluice according to claim 7, wherein said housing halves are identical.

9. Sluice according to claim 8, wherein said stubs disposed on said upper housing half are in the form of a flow inlet, a refilling opening for the cleaning bodies and an inspection window, and said stubs disposed on said lower housing half are in the form of a flow outlet, a removal outlet for the cleaning bodies, and said one stub to which said drive flange is connected.

10. Sluice according to claim 9, wherein said housing halves can be selectively positioned relative to each other.

11. Sluice according to claim 1, including an intermediate tubular member having two flanges, disposed between said housing halves.

12. Sluice for cleaning bodies, comprising a sluice housing of a cleaning installation for tube heat exchangers having two substantially hemispherical housing halves, flanges each being disposed on a respective housing half for interconnecting said halves, substantially radially projecting stubs disposed on each respective housing half including at least one inlet and at least one outlet stub for flow medium carrying the cleaning bodies, a screen element disposed in said housing for selectively covering at least one of said inlet and outlet stubs, and means for selectively positioning said screen in said housing.

* * * * *